US007488893B2

(12) United States Patent
Nakayama et al.

(10) Patent No.: US 7,488,893 B2
(45) Date of Patent: Feb. 10, 2009

(54) FLEXIBLE NON-HALOGEN ELECTRIC WIRES

(75) Inventors: Akinari Nakayama, Hitachi (JP); Michiaki Shimizu, Hitachi (JP)

(73) Assignee: Hitachi Cable, Ltd., Tokyo (JP)

( * ) Notice: Subject to any disclaimer, the term of this patent is extended or adjusted under 35 U.S.C. 154(b) by 0 days.

(21) Appl. No.: 11/847,393

(22) Filed: Aug. 30, 2007

(65) Prior Publication Data

US 2008/0053696 A1 Mar. 6, 2008

(30) Foreign Application Priority Data

Aug. 31, 2006 (JP) ..... 2006-236068
Jul. 11, 2007 (JP) ..... 2007-181572

(51) Int. Cl.
*H01B 7/04* (2006.01)

(52) U.S. Cl. ..... 174/110 R

(58) Field of Classification Search ..... 174/110 R, 174/105 R, 110 PM
See application file for complete search history.

(56) References Cited

U.S. PATENT DOCUMENTS 6,162,540 A * 12/2000 Tsuji et al. ..... 428/375
2002/0108772 A1* 8/2002 Hase et al. ..... 174/120 C

FOREIGN PATENT DOCUMENTS

| | | |
|---|---|---|
| JP | 2000-248126 | 9/2000 |
| JP | 2000-327858 | 11/2000 |
| JP | 2001-110236 | 4/2001 |
| JP | 2004-339459 | 12/2004 |

* cited by examiner

*Primary Examiner*—Chau N Nguyen
(74) *Attorney, Agent, or Firm*—Antonelli, Terry, Stout & Kraus, LLP.

(57) ABSTRACT

A flexible, non-halogen electric wire comprises a conductor fabricated by twisting a plurality of strands and an insulator covering the conductor; wherein: the diameter of each of strands is 0.12 to 0.31 mm; the insulator includes an ethylene copolymer including 25 to 40 weight percent of vinyl monomer, which has an oxygen element in its molecular structure, other than vinyl acetate as a main constituent and also includes an elastomer as an accessory constituent; the main and accessory constituents are mixed to prepare a resin material; the resin material and a metallic hydroxide are mixed to prepare a cladding material; the conductor is covered with the cladding material; and the cladding material is then bridged to form a cross-linked resin.

11 Claims, 2 Drawing Sheets

FLEXIBLE NON-HALOGEN ELECTRIC WIRES

CLAIM OF PRIORITY

The present application claims priority from Japanese application serial no. 2007-181572 filed on Jul. 11, 2007, which further claims priority from Japanese patent application serial no. 2006-236068 filed on Aug. 31, 2006, the contents of which are hereby incorporated by reference into this application.

BACKGROUND OF THE INVENTION

1. Field of the Invention

The present invention relates to non-halogen, flame-retardant electric wires, and particularly to flexible, non-halogen electric wires that are superior in flexibility.

2. Description of Related Art

Non-halogen, flame-retardant electric wires and cables (collectively referred to below as non-halogen electric wires) are widely used as polyvinyl chloride (PVC) alternatives. The non-halogen, flame-retardant material used as an insulator of the non-halogen electric wire is a resin composition prepared by adding a large amount of metallic hydroxide, as a flame retardant, to polyolefin polymer such as polyethylene, ethylene vinyl acetate copolymer (EVA) or ethylene ethyl acrylate copolymer (EEA), or to olefin rubber such as ethylene propylene rubber (EPDM).

When the non-halogen electric wire is required to be heat-resistant, a bridged resin composition is used as the non-halogen, flame-retardant material, which is insulative. A non-halogen resin composition with excellent flame-retardant properties is proposed in which the resin has high mechanical strength and no residual strain after forming, as described in JP-A-2000-327858.

Conventional non-halogen electric wires have less flexibility because the insulator is prepared by adding a large amount of metallic hydroxide to the resin composition used as the non-halogen, flame-retardant material. Accordingly, it is difficult to obtain both flame retardancy and flexibility from the conventional non-halogen electric wires as in PVC electric wires and cables.

Although olefin rubber such as EPDM is flexible, it generates much heat when it is burned because the molecular structure of the polymer does not include oxygen. Accordingly, it is difficult to obtain sufficient flame retardancy.

On the other hand, a possible way to increase the flexibility of the electric wire is to increase the flexibility of a metal conductor (simply referred to below as the conductor), which is fabricated by twisting a plurality of strands. However, if the diameter of each strand is reduced to increase the flexibility of the conductor, the conductor or strands become likely to be broken when the electric wire is manufactured or processed.

Accordingly, non-halogen electric wires superior in flexibility are extremely difficult to provide due to the above problems.

SUMMARY OF THE INVENTION

Under these circumstances, it is an object of the present invention to address these problems and to provide flexible, non-halogen electric wires superior in flexibility. Of course, it should be understood that considerations are involved in increase in heat resistance, flame retardancy, and mechanical strength, in easiness in terminal treatment, mixing and processing, and extrusion, and in improvement in oil resistance, cold resistance, and abrasion resistance, besides an inexpensive material, and non-release of materials to the ambience.

(1) According to one aspect of the present invention, a non-halogen electric wire comprises a conductor fabricated by twisting a plurality of strands and an insulator covering the conductor; wherein the diameter of each of the strands is 0.12 to 0.31 mm; the insulator includes an ethylene copolymer including 25 to 40 weight percent of vinyl monomer, which has an oxygen element in its molecular structure, other than vinyl acetate as a main constituent and also includes an elastomer as an accessory constituent; the main constituent and the accessory constituent are mixed to prepare a resin material; the resin material and a metallic hydroxide are mixed to prepare a cladding material; the conductor is covered with the cladding material; and the cladding material is then bridged to form a cross-linked resin.

In the above invention (1), the following modifications and changes can be made.

(i) The metallic hydroxide is added by 50 to 300 parts by weight to 100 parts by weight of the resin material.

(ii) The ethylene copolymer is prepared by chemically bonding the vinyl monomer and an ethylene, resulting in one copolymer or more than one blended copolymers selected from a group of an ethylene-ethyl acrylate copolymer (EEA), an ethylene-methyl acrylate copolymer (EMA), an ethylene-butyl acrylate copolymer (EBA), an ethylene-methyl methacrylate copolymer (EMMA), ethylene-acrylic rubber, an ethylene-ethyl acrylate-maleic anhydride terpolymer, a maleic anhydride modified EEA, a maleic anhydride modified EBA, a maleic anhydride modified EMA, an ethylene-glycidyl methacrylate copolymer, an ethylene-diethylaminoethyl methacrylate copolymer, an ethylene-dimethylaminoethyl methacrylate copolymers, an ethylene-methacrylic acid 2-hydroxyethyl copolymer, an ethylene-methacrylic acid 2-hydroxypropyl copolymer, and an ethylene-tetrahydrofurfuryl methacrylate copolymer.

(iii) The elastomer is prepared by selecting one or by mixing more than one from a group of ethylene-propylene copolymer rubber (EPR), ethylene-propylene-diene terpolymer rubber (EPDM), acrylonitrile butadiene rubber (NBR), hydrogenated NBR, acrylic rubber, ethylene-acrylic ester copolymer rubber, ethylene-octene copolymer rubber (EOR), ethylene-butene-1 copolymer rubber (EBR), very low density polyethylene (VLDPE), a reactor blend (implant) thermoplastic elastomer in which olefin rubber such as EPR is dispersed with a size of 1 μm or less in polypropylene (PP), styrene thermoplastic elastomers such as polystyrene-polybutadiene-polystyrene (SBS), polystyrene-polyisoprene-polystyrene (SIS), and polystyrene-polyethylene/butylene-polystyrene (SEBS), styrene-butadiene copolymer rubber (SBR), hydrogenated SBR, and a styrene-ethylene random copolymer.

(iv) The cladding material includes a smoothness adding agent with 5 weight percent or less of the added metallic hydroxide to 100 weight parts of the resin material.

(v) The smoothness adding agent has a melting point of 100° C. or below, and is any one of fatty acid metallic salt, fatty acid amide, fatty acid ester, fatty acid ester of polyalcohol, and a derivative of fatty acid ester of polyalcohol.

(vi) The vinyl monomer is ethyl acrylate or methyl acrylate.

(vii) A surface of the conductor is plated with tin, nickel, silver, or gold.

(viii) An outer periphery of the conductor is wound by a plastic, paper, cloth, or metal foil separator tape.

(ix) An electromagnetic shield comprising braided metal wires, a metal tape, or conductive resin may be provided on the outer periphery of the above conductor.

(Advantages of the Invention)

The present invention provides an advantage as described below. A flexible, non-halogen electric wire superior in flexibility can be achieved.

DETAILED DESCRIPTION OF THE PREFERRED EMBODIMENTS

Preferred embodiments according to the present invention will be described below with reference to the attached drawings. However, the present invention is not limited to the embodiments described herein.

Figure 1A:
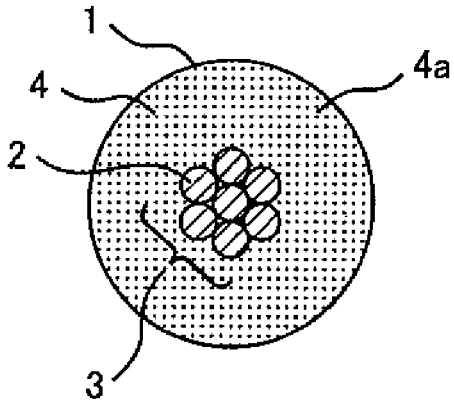
FIG. 1A is a schematic illustration showing a cross sectional view of a flexible, non-halogen electric wire in a preferred embodiment of the present invention.

FIG. 1A is a schematic illustration showing a cross sectional view of a flexible, non-halogen electric wire in a preferred embodiment of the present invention. As shown in FIG. 1A, a flexible, non-halogen electric wire 1 in a preferred embodiment according to the present invention is fabricated by twisting a plurality of strands 2 to form a conductor (copper conductor) 3 and then by covering the conductor 3 with an insulator 4. A diameter of each of the plurality of strands 2 is 0.12 to 0.31 mm. The insulator 4 contains an ethylene copolymer (not shown) including 25 to 40 weight percent of vinyl monomer (not shown), which has an oxygen element in its molecular structure, other than vinyl acetate as a main constituent and also contains an elastomer (not shown) as an accessory constituent. The main constituent and the accessory constituent are mixed to prepare a resin material (not shown); the resin material and a metallic hydroxide (not shown) are mixed to prepare a cladding material (not shown); and then the conductor 3 is covered with the cladding material. After that, the cladding material is bridged to form cross-linked resin 4*a*.

Figure 1B:
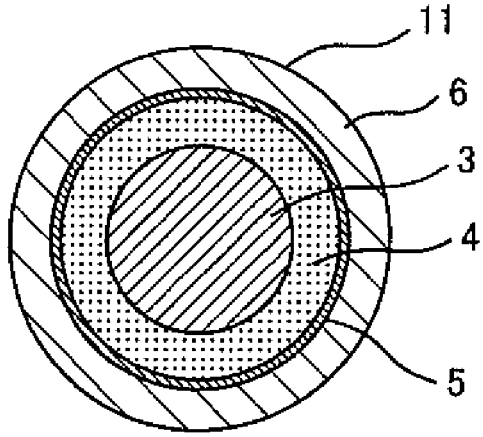
FIG. 1B is a schematic illustration showing a cross sectional view of another flexible, non-halogen electric wire in a preferred embodiment of the present invention.

FIG. 1B is a schematic illustration showing a cross sectional view of another flexible, non-halogen electric wire in a preferred embodiment of the present invention. With a flexible, non-halogen electric wire 11 according to the present invention, as shown in FIG. 1B, an electromagnetic shield 5 may be provided on the outer periphery of the insulator 4, and a sheath 6 may be further disposed on the outer periphery of the electromagnetic shield 5.

Figure 1C:
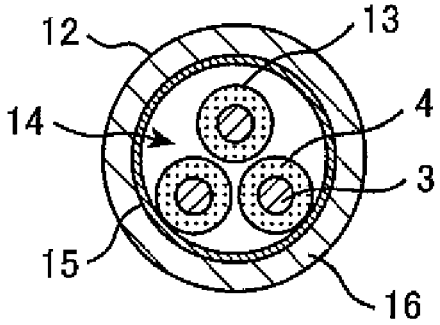
FIG. 1C is a schematic illustration showing a cross sectional view of another flexible, non-halogen electric wire in a preferred embodiment of the present invention.

FIG. 1C is a schematic illustration showing a cross sectional view of another flexible, non-halogen electric wire in a preferred embodiment of the present invention. With a flexible, non-halogen electric wire 12 according to the present invention, as shown in FIG. 1C, an insulator core 14 may be fabricated by twisting a plurality of flexible, non-halogen electric wires 13, each of which is fabricated by covering the conductor 3 with the insulator 4. A shield 15 may be configured around the outer periphery of the insulator core 14. An overall sheath 16 may be further provided around the outer periphery of the shield 15.

Figure 2:
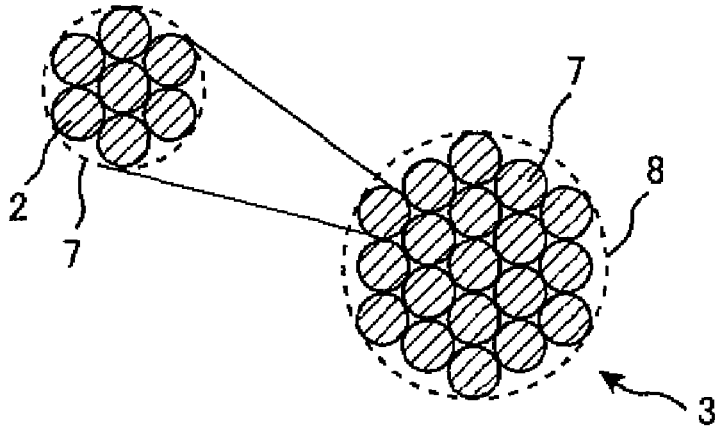
FIG. 2 is a schematic illustration showing a cross sectional view of a conductor and a partial magnified view of the conductor in a preferred embodiment of the present invention.

FIG. 2 is a schematic illustration showing a cross sectional view of a conductor and a partial magnified view of the conductor in a preferred embodiment of the present invention. As shown in FIG. 2, a plurality of strands 2 (seven strands in the drawing) are twisted to form a child strand 7; a plurality of child strands 7 (19 child strands in the drawing) are twisted to form a parent strand 8; the parent strand 8 is the conductor 3.

Next, described below will be an advantage achieved when the diameter of the strand 2 is within a range of 0.12 to 0.31 mm.

The flexibility of an electric wire usually increases with decreasing its diameter. However, the strand is more likely to be broken during terminal treatment such as removal of the insulator or terminal crimping as the strand becomes thinner. In the present invention, the diameter of the stand is preferable to be 0.31 mm or less because the desired flexibility can be obtained when the strand diameter is 0.31 mm or less. While, the strand diameter is also preferable to be 0.12 mm or more in the present invention. When the strand diameter is 0.12 mm or more, the strand is hard to break and its terminal can be easily treated. Accordingly, the flexible, non-halogen electric wire 1 in a preferred embodiment, the strand diameter of which is stipulated to be within a range of 0.12 to 0.31 mm, can provide the target flexibility and can make its terminal treatment easy.

The conductor 3 is fabricated by twisting a plurality of strands 2 to form a child strand 7 and then twisting a plurality of child strands 7 to form a parent strand 8, thereby increasing the flexibility of the wire.

As the results of detail analyzing the flexibility of wire by the inventors, it is found that the desired flexibility can be obtained only when the diameter of the strand 2 is within a range of 0.12 to 0.31 mm and the insulator 4 according to the present invention is used.

The effect provided by the insulator 4 depends on the composition of the insulator 4. Therefore, the insulator 4 will be described together with its composition. The insulator 4 is prepared by covering a cladding material around the periphery of the conductor 3 and then bridging the cladding material. Firstly, the cladding material will be explained.

It is preferable that the vinyl monomer used for the cladding material contains an oxygen element in its molecular structure.

With the ethylene copolymer to be described below, in which a vinyl monomer including oxygen in its molecular structure is used as part of the raw materials, decomposed materials with a low molecular weight, which have been already oxidized, are emitted to a combustion field during the combustion. So the ethylene copolymer has an effect to reduce combustion energy. The ethylene copolymer is thereby useful to make non-halogen materials flame-retardant by a way in which an insulator is prepared by a cladding material obtained by adding a metallic hydroxide to a resin material.

With ethylene vinyl acetate copolymer (EVA), which is generally used as a base polymer of a non-halogen resin composition, however, acetic acid disengages at high temperatures, and thus molecular chains are easily broken. The acetic acid is released to the ambience. Accordingly, EVA is inferior in heat resistance. When acetic acid disengages from EVA, peripheral units mounted around the wire may cause corrosion. In the present invention, EVA including vinyl acetate (VA) is not suitable for the cladding material.

A vinyl monomer, other than vinyl acetate, which includes oxygen in its molecular structure is added to the ethylene copolymer by 25 to 40 weight percent. That is, the ethylene copolymer comprises 25 to 40 weight percent of vinyl monomer and 75 to 60 weight percent of ethylene. When less than 25 weight percent of vinyl monomer is included, the flexibility of the ethylene copolymer becomes insufficient. When more than 40 weight percent of vinyl monomer is included, the glass transition temperature of the ethylene copolymer reaches near to an ordinary temperature, abruptly decreasing cold resistance. Furthermore, in order to obtain suitable flame retardancy, the ethylene copolymer is preferably the main component (a component that occupies 50% or more by weight) of the resin material.

The ethylene copolymer obtained as described above is used as the main constituent, and the above elastomer is used as the accessory constituent. The main constituent and the accessory constituent are then mixed to form a resin material. The resin material and a metallic hydroxide are mixed to form a cladding material.

The ethylene copolymer used as the main constituent is prepared by chemically bonding a vinyl monomer and an ethylene. As a result, one copolymer or more than one blended copolymers from the following copolymers can be obtained: ethylene-ethyl acrylate copolymer (EEA), ethylene-methyl acrylate copolymer (EMA), ethylene-butyl acrylate copolymer (EBA), ethylene-methyl methacrylate copolymer (EMMA), ethylene-acrylic rubber, ethylene-ethyl acrylate-maleic anhydride terpolymer, maleic anhydride modified EEA, maleic anhydride modified EBA, maleic anhydride modified EMA, ethylene-glycidyl methacrylate copolymer, ethylene-diethylaminoethyl methacrylate copolymer, ethylene-dimethylaminoethyl methacrylate copolymer, ethylene-methacrylic acid 2-hydroxyethyl copolymer, ethylene-methacrylic acid 2-hydroxypropyl copolymer, and ethylene-tetrahydrofurfuryl methacrylate copolymer.

When heat resistance, material costs, flame redardancy, flexibility, and other factors are comprehensively considered, EEA or EMA is optimum as ethylene. Particularly, EMA synthesized in a low-temperature polymerization process includes methyl acrylate (MA) by as high as 30%. When the EMA has a high molecular weight, it provides both flexibility and mechanical strength.

The elastomer used as the accessory constituent is prepared by selecting one or by mixing more than one from a group of ethylene-propylene copolymer rubber (EPR), ethylene-propylene-diene terpolymer rubber (EPDM), acrylonitrile butadiene rubber (NBR), hydrogenated NBR, acrylic rubber, ethylene-acrylic ester copolymer rubber, ethylene-octene copolymer rubber (EOR), ethylene-butene-1 copolymer rubber (EBR), very low density polyethylene (VLDPE), a reactor blend (implant) thermoplastic elastomer in which olefin rubber such as EPR is dispersed with a size of 1 μm or less in polypropylene (PP), styrene thermoplastic elastomers such as polystyrene-polybutadiene-polystyrene (SBS), polystyrene-polyisoprene-polystyrene (SIS), and polystyrene-polyethylene/butylene-polystyrene (SEBS), styrene-butadiene copolymer rubber (SBR), hydrogenated SBR, and a styrene-ethylene random copolymer.

To increase the flexibility, it is desirable that the elastomer used as the accessory constituent be a rubber-like polymer not having a crystal structure in its molecular structure. To facilitate mixing and processing, it is preferably that the elastomer can be supplied in a pellet form. An inexpensive material is desirable. Accordingly, EOR is most suitable as an inexpensive polymer that can be supplied in a pellet form. When resistance to oil is required, ethylene acrylic ester copolymer is preferable.

Generally, when an ethylene copolymer includes 25 or more weight percent of vinyl monomer, its polarity becomes high, increasing adherence during mixing and processing or during extrusion. Characteristics in processing are then lowered. In other words, there is a fear that the adherence of the cladding material increases. However, it is clarified by the inventors that, in the cladding material, a smoothness adding agent with 5 weight percent or less of metallic hydroxide should be added to 100 weight parts of resin material in order to efficiently prevent adherence from increasing. Both flexibility and processing can be increased by including 25 or more weight percent of vinyl monomer and adding the smoothness adding agent, respectively.

Furthermore, the smoothness adding agent has a melting point of 100° C. or below, and is preferable to be any one of fatty acid metallic salt, fatty acid amide, fatty acid ester, fatty acid ester of polyalcohol, and derivatives of these materials.

Additionally, it was revealed that addition of the smoothness adding agent brought an unexpected effect in which the flame retardancy was also improved. On the other hand, when a material with a melting point exceeding 100° C. is added as the smoothness adding agent, the flame retardancy is conversely lowered. Although the reason for this phenomenon is not clear for the present, it can be considered that, part of fatty acid metallic salt, fatty acid amide, fatty acid ester, fatty acid ester of polyalcohol, and derivatives of these materials also functions as an internal smoothness agent and a dispersing agent for inorganic particles in polymers with a relatively high polarity. Furthermore, it can be estimated that if these smoothness adding agents are left as crystals without being melted at about 100° C., at which the cladding material is mixed and processed, the easiness of the dispersion of the metallic hydroxide, which is a flame retardant, is decreased, and the flame retardancy of the smoothness adding agents are lowered since they are inflammables.

The amount of smoothness adding agent to be added needs to be limited. When the amount of smoothness adding agent added exceeds 5 weight percent of the metallic hydroxide, the flame retardancy abruptly decreases. Accordingly, the maximum amount of smoothness adding agent to be added should not exceed 5 weight percent of the metallic hydroxide.

Fatty acid metallic salt includes unsaturated fatty acid metallic salts with a melting point of 100° C. or below, such as recinoleic acid, calcium recinolate, and zinc oleate.

Unsaturated or saturated fatty acid amide with a melting point of 100° C. or below includes monoamide such as oleic amide, erucic amide, and lauric amide, and includes bisamide such as ethylene bis-hydroxy stearic amide.

Fatty acid ester includes carnauba wax, montanic acid ester, and partially-saponified montanic acid ester.

Fatty acid ester of polyalcohol includes partial or complete ester prepared from fatty acid with a carbon number of 8 to 30 and polyalcohol, such as ethylene glycol, polyethylene glycol, polypropylene glycol, glycerin, trimethylolpropane, pentaerythritol, sorbitol, and sorbitan. Examples include ethylene glycol monostearate, polyethylene glycol monostearate or distearate, glycerin monostearate, trimethylolpropane trilaurate, soybean oil, and linseed oil.

Derivatives of fatty acid ester of polyalcohol include epoxidized soybean oil and epoxidized linseed oil.

Of the smoothness adding agents listed above, oleic amide is determined to be suitable from the viewpoint of the smoothness adding effect and flame retardancy for the cladding material.

In the present invention, the cladding material is prepared by mixing the resin material and the metallic hydroxide and then adding the smoothness adding agent to the mixture, as described above.

The metallic hydroxide is preferably added by 50 to 300 parts by weight to 100 parts by weight of the resin material. Any amount of metallic hydroxide can be added within this range. When less than 50 parts by weight are added, the flame retardancy effect is insufficient. When more than 300 parts by weight are added, the wear resistance of the electric wire is reduced, thereby causing the surface of the electric wire to be easily scratched during treatment.

The metallic hydroxide flame retardants include magnesium hydrate ($Mg(OH)_2$), aluminum hydroxide ($Al(OH)_3$), hydrotalcite, calcium aluminate hydrate, calcium hydroxide, barium hydroxide, and hard clay. The magnesium hydrate includes synthesized magnesium hydrate, natural magnesium hydrate obtained by crushing natural brucite mineral ores, and solid solutions formed with other elements such as nickel (Ni). From the viewpoint of mechanical characteristics, easiness of dispersion and flame retardancy, more preferable metallic hydroxide flame retardants include coarse particles with an average particle diameter of 4 μm or less and those with an average particle diameter of 10 μm or more by 10% or less, where the diameters of the particles are measured with a laser-type particle distribution measuring instrument. To make these particle water-resistant, heat-resistant, and easy-to-disperse, it is also possible to treat the surfaces of the particles in a usual manner by means of fatty acid, fatty acid metallic salt, a silane coupling agent, a titanate coupling agent, acrylic resin, phenol resin, cationic or non-ionic water-soluble resin, or the like. Particularly, particles treated with the silane coupling agent is preferable.

The cladding material is placed around the conductor and then bridged, resulting in a bridged resin composition. Bridging is performed to increase heat resistance. Bridging methods include peroxide bridging based on organic oxide, chemical bridging such as sulfur vulcanization using sulfur oxide, irradiation bridging based on electric beams and radiation emissions, and bridging based on chemical reactions. Any of these bridging methods can be used. The peroxide bridging is preferable because it is superior in heat resistance and reduces a manufacturing cost.

Additives can be added to the cladding materials, as necessary; the additives include flame retardancy auxiliary agents, antioxidants, lubricants, surfactants, softeners, plasticizer, inorganic fillers, solubilizing agents, stabilizers, bridging agents, ultraviolet absorbents, light stabilizers, and coloring agents. Flame retardancy auxiliary agents include phosphorus flame retardants, silicone flame retardants, nitrogen flame retardants, boron compounds, and zinc compounds.

The conductor sizes (cross sectional areas) of non-halogen electric wires to which the present invention is applied include 35SQ and 22SQ described in examples below. The present invention can be applied to non-halogen electric wires with any conductor size.

The non-halogen electric wires may be twisted in pairs or together, or may be tied in a bundle without being twisted. The outer periphery of the electric wire may be covered with a non-halogen sheath.

The flexible, non-halogen electric wires according to the present invention can be used for vehicles, automobiles, devices, electric power, metal communications, control, and wiring in control panels. In these applications, the flexible, non-halogen electric wires of the present invention are superior in easiness of wiring. Electric wires with a relative large conductor size of 20SQ or more are used for hybrid vehicles and electric cars using secondary cells or fuel cells because high current flows. The flexible, non-halogen electric wires of the present invention are also suitable as wires in automobiles requiring relatively large conductor sizes. In fields of electric parts such as connectors and inverters, there is a strong demand for compactness, so spaces for wiring are extremely small and thus electric wires are bent sharply near connectors. The flexible, non-halogen electric wires of the present invention are also suitable as wires bent sharply in this way.

The insulator may directly touch the conductor, in which case the resin in the insulator is sometimes deteriorated by metallic ions in the conductor. In order to prevent this phenomenon, it is preferable that the surface of the conductor be plated with tin, nickel, silver, or gold.

Furthermore, it is preferable that an antioxidant or metallic chelating agent be added to the cladding material that forms the insulator. Hindered phenolic compounds and hindered amine compounds are suitable as antioxidants. It is more suitable to use these antioxidants together with a phosphite compound or a sulfur-based antioxidant such as a thioether compound. The metallic chelating agents include triazine compounds, triazole compounds, hydrazine compounds, oxalic compounds, and salicylic compounds.

In addition, a separator tape may be disposed between the conductor and the insulator so as to allow the insulator to be easily peeled at a terminal. It suffices to wind the separator tape around the outer periphery of the conductor. The separator tape may be made of plastic, paper, cloth, or metal foil. When the separator tape is made of nylon or polyester, the insulator can be easily peeled.

When an electromagnetic shield comprising braided metal wires, a metal tape, or conductive resin is provided around the outer periphery of the conductor, electric noise that flows between the external environment and the conductor can be reduced. It is more preferable to apply extrusion claddinging of conductive resin with a volume resistivity of 1 Ω·cm or less to the outer periphery of the insulator, because the manufacturing can be carried out extremely fast.

EXAMPLES

TABLE 1

| | Conductor size | |
|---|---|---|
| | 35SQ | 22SQ |
| Conductor structure | (a) 37/92/0.11<br>(b) 19/73/0.18<br>(c) 19/26/0.30<br>(d) 7/45/0.38 | (e) 37/92/0.09<br>(e) 19/83/0.13<br>(e) 7/45/0.30<br>(e) 7/39/0.32 |

As indicated in Table 1, seven tin-plated copper strands with different outer diameters were used to fabricate eight conductors. The sizes of conductors (a) to (d) are 35SQ, and the sizes of conductors (e) to (h) are 22SQ. A detailed structure of a conductor is represented by "the number of parent twisted wires/the number of child twisted wires/a strand diameter in millimeters" in Table 1. As shown in FIG. 2, the number of parent twisted wires indicates the number of child twisted wires 7 used to form a single parent twisted wire 8. The number of child twisted wires indicates the number of strands 2 used to form a single child twisted wire 7. Since the flexible, non-halogen electric wires of the present invention use strands with a diameter of 0.12 to 0.31 mm, conductors (b), (c), (f), and (g) are applicable to the present invention. The strand diameters of conductors (a) and (e) are smaller than 0.12 mm, and those of conductors (d) and (h) exceed 0.31 mm.

TABLE 2

| | | | Blend composition | | | | | | | | | | | | | | |
|---|---|---|---|---|---|---|---|---|---|---|---|---|---|---|---|---|---|
| | | | #1 | #2 | #3 | #4 | #5 | #6 | #7 | #8 | #9 | #10 | #11 | #12 | #13 | #14 | #15 |
| Materials | a | EMA (MA31%, MI0.6) | | 70 | | 100 | 60 | | | 100 | | 60 | | 60 | | | 60 |
| | b | EMMA (MMA25%, MI7) | 100 | | | | | | | | | | | | | | |
| | c | EEA (EA34%, MI5) | | | 100 | | | | 100 | | | | | | | | |
| | d | EEA (EA34%, MI2.5) | | | | | | | | | 100 | | | | 100 | 100 | |
| | e | EEA (EA19%, MI5) | | | | | | | | | | | 55 | | | | |
| | f | EVA (VA33%, MI0.2) | | | | | | 80 | | | | | | | | | |
| | g | Ethylene-octene copolymer rubber (specific gravity: 0.86) | | | | | 40 | 20 | | | | 40 | 45 | 40 | | | 40 |
| | h | Acrylic rubber Vamac DP | | 30 | | | | | | | | | | | | | |
| | i | Magnesium hydrate Kisuma 5L | 90 | 120 | 100 | 100 | 100 | 80 | 100 | 100 | 100 | 100 | 80 | 100 | 100 | 100 | 100 |
| | j | Irganox 1010 | 2 | 2 | 2 | 2 | 2 | 2 | 2 | 2 | 2 | 2 | 2 | 2 | 2 | 2 | 2 |
| | k | DLTDP | 3 | 3 | 3 | 3 | 3 | 3 | 3 | 3 | 3 | 3 | 3 | 3 | 3 | 3 | 3 |
| | 1 | DCP | 3 | 3 | 3 | 3 | 3 | 3 | 3 | 3 | 3 | 3 | 3 | 3 | 3 | 3 | 3 |
| | m | Zinc oleate (Tm: 85° C.) | | | | | | 2 (2.5) | | | | | | | | | |
| | n | Oleic amide (Tm: 75° C.) | | | | | | | | | | 1 (1) | 2 (2.5) | 7 (7) | | | |
| | o | Ethylene bis-iso-stearic amide (Tm: 100° C.) | | | | | | | | 1 (1) | | | | | | | |
| | p | Epoxidized soybean oil (liquid) | | | | | | | 1 (1) | | | | | | | | |
| | q | Carnauba wax (Tm: 85° C.) | | | | | | | | | 4 (4) | | | | 6 (6) | | |
| | r | Magnesium behenate (Tm: 106° C.) | | | | | | | | | | | | | | 1 (1) | |
| | s | Hexamethylene bis-stearic amide (Tm: 146° C.) | | | | | | | | | | | | | | | 1 (1) |

Fifteen cladding materials were fabricated by using materials indicated in Table 2. Each cladding material is assigned a blending number from #1 to #15. Materials at (a) to (d) are ethylene copolymers including the vinyl monomer according to the present invention. Material at (e) is ethylene copolymer including the vinyl monomer, which was prepared for comparison purposes. EVA at (f) is a material used for conventional insulators. Ethylene octene copolymer rubber (EOR) at (g) is an elastomer. Acrylic rubber Vamac DP at (h) is a polymer used as the accessory constituent to prepare a resin material according to the present invention. Magnesium hydrate Kisuma 5L at (i) is metallic hydroxide. Irganox 1010 at (j) and DLTDP (k) are antioxidants. DCP at (1) is a bridging agent. Materials at (m) to (s) are smoothness adding agents. The values in the columns of the materials indicate blended amounts. The values in parentheses in the columns of the smoothness adding agents indicate weight percents to the metallic hydroxide.

The cladding materials with blending numbers #1 to #5, #7 to #10, and #12 to #15 in Table 2 are applicable to the present invention. That is, an ethylene copolymer is prepared by chemically bonding 25 to 40 weight percent of vinyl monomer including an oxygen element and 75 to 60 weight percent of ethylene. The ethylene copolymer (main constituent) and an elastomer (accessory constituent) are mixed to prepare a resin material. The resin material and the metallic hydroxide are mixed to prepare a cladding material. The material with blending number #6 is inferior in heat resistance because it uses EVA, so it is not applicable to the present invention. The material with blending number #11 is hard and inferior in flexibility because it includes as small as 19 weight percent of vinyl monomer (EA), so it is also not applicable to the present invention.

The materials with blending numbers #1 to #15 in Table 2 were mixed with a 75 L Kneader. After this mixing, the mixed materials were supplied to a 50-nm feeder ruder, and strands were cut to pellets (a primary pellet process and a secondary pellet process were carried out; in the first pellet process, the materials other than the bridging agents were mixed to prepare pellets, and in the secondary pellet process, a bridging agent was added to the mixed pellets to prepare mixed pellets again). The mixed materials in the pellet form were used as a wire cladding compound. This wire cladding compound is a cladding material to prepare the insulator 4 (see FIG. 1A).

Next, the conductors in Table 1 and the cladding materials in Table 2 were used in combinations as indicated in Tables 3 to 5 to prepare 33 types of non-halogen electric wires with the sectional structure shown in FIG. 1A (the flexible, non-halogen electric wires 1 according to the present invention and non-halogen electric wires used for comparison purposes). Specifically, the cladding materials with blending numbers #1 to #15 were extruded by a 4.5-inch continuous steam bridge extruder together with conductors (a) to (h), and then were bridged to prepare non-halogen electric wires with an insulator thickness of 1.0 mm. The bridging was performed under a high steam pressure of 1.8 MPa. Tables 3 and 4 indicate Examples $1 to $23, and Table 5 indicates Comparative examples &1 to &10.

The non-halogen electric wires 1 thereby prepared were evaluated or investigated as described below. The results are indicated in Tables 3 to 5.

TABLE 3

| | | Example | | | | | | | | | | | | | |
|---|---|---|---|---|---|---|---|---|---|---|---|---|---|---|---|
| | | $1 | $2 | $3 | #4 | $5 | $6 | $7 | $8 | $9 | $10 | $11 | $12 | $13 | $14 |
| | | Blending number | | | | | | | | | | | | | |
| | | #1 | #2 | #3 | #4 | #5 | #7 | #8 | #9 | #10 | #1 | #4 | #5 | #8 | #10 |
| | | Conductor structure | | | | | | | | | | | | | |
| | | (c) 19/26/0.30 | | | | | | | | | (b) 19/73/0.18 | | | | |
| 35SQ | Easiness of mixing and processing | Δ | Δ | Δ | Δ | Δ | ○ | ○ | ○ | ○ | Δ | Δ | Δ | ○ | ○ |
| | Elongation after heating | 130 | 210 | 210 | 210 | 200 | 220 | 225 | 210 | 200 | 130 | 210 | 200 | 225 | 200 |
| | Heat resistance | Δ | ○ | ○ | ○ | ○ | ○ | ○ | ○ | ○ | Δ | ○ | ○ | ○ | ○ |
| | Distortion | 55 | 80 | 50 | 75 | 80 | 55 | 75 | 85 | 80 | 100 | 125 | 130 | 130 | 135 |
| | Flexibility | Δ | Δ | Δ | Δ | Δ | Δ | Δ | Δ | Δ | ○ | ○ | ○ | ○ | ○ |
| | Combustion time | 15 | 12 | 12 | 10 | 12 | 5 | 3 | 3 | 6 | 13 | 10 | 11 | 2 | 5 |
| | Flame retardancy | Δ | Δ | Δ | Δ | Δ | ○ | ○ | ○ | ○ | Δ | Δ | Δ | ○ | ○ |
| | Easiness of terminal treatment | ○ | ○ | ○ | ○ | ○ | ○ | ○ | ○ | ○ | ○ | ○ | ○ | ○ | ○ |
| | Cold resistance | ○ | ○ | ○ | ○ | ○ | ○ | ○ | ○ | ○ | ○ | ○ | ○ | ○ | ○ |

| | | Example | | | | |
|---|---|---|---|---|---|---|
| | | $15 | $16 | $17 | $18 | $19 |
| | | Blending number | | | | |
| | | #1 | #3 | #10 | #1 | #10 |
| | | Conductor structure | | | | |
| | | (g) 7/45/0.30 | | | (f) 19/83/0.13 | |
| 22SQ | Easiness of mixing and processing | Δ | Δ | ○ | Δ | ○ |
| | Elongation after heating | 120 | 205 | 200 | 125 | 215 |
| | Heat resistance | Δ | ○ | ○ | Δ | ○ |
| | Distortion | 65 | 60 | 90 | 115 | 145 |
| | Flexibility | Δ | Δ | Δ | ○ | ○ |
| | Combustion time | 18 | 16 | 9 | 17 | 7 |
| | Flame retardancy | Δ | Δ | ○ | Δ | ○ |
| | Easiness of terminal treatment | ○ | ○ | ○ | ○ | ○ |
| | Cold resistance | ○ | ○ | ○ | ○ | ○ |

TABLE 4

| | | Example | | | |
|---|---|---|---|---|---|
| | | $20 | $21 | $22 | $23 |
| | | Blending number | | | |
| | | #12 | #13 | #14 | #15 |
| | | Conductor structure (b) 19/73/0.18 | | | |
| 35SQ | Easiness of mixing and processing | ○ | ○ | ○ | ○ |
| | Elongation after heating | 200 | 200 | 210 | 205 |
| | Heat resistance | ○ | ○ | ○ | ○ |
| | Distortion | 140 | 140 | 95 | 90 |
| | Flexibility | ○ | ○ | Δ | Δ |
| | Combustion time | 21 | 15 | 20 | 28 |
| | Flame retardancy | Δ | Δ | Δ | Δ |

TABLE 4-continued

| | Example | | | |
|---|---|---|---|---|
| | $20 | $21 | $22 | $23 |
| | Blending number | | | |
| | #12 | #13 | #14 | #15 |
| | Conductor structure (b) 19/73/0.18 | | | |
| Easiness of terminal treatment | ○ | ○ | ○ | ○ |
| Cold resistance | ○ | ○ | ○ | ○ |

TABLE 5

| | | Comparative example | | | | | |
|---|---|---|---|---|---|---|---|
| | | &1 | &2 | &3 | &4 | &7 | &8 |
| | | Blending number | | | | | |
| | | #6 | #11 | #9 | #7 | #1 | #10 |
| | | Conductor structure | | | | | |
| | | (b) | | (d) | | (a) | |
| 35SQ | Easiness of mixing and processing | Δ | ○ | ○ | ○ | ○ | ○ |
| | Elongation after heating | 30 | 215 | 210 | 225 | 210 | 205 |
| | Heat resistance | x | ○ | ○ | ○ | ○ | ○ |
| | Distortion | 145 | 40 | 45 | 35 | 150 | 150 |
| | Flexibility | ○ | x | x | x | x | ○ |
| | Combustion time | 4 | 7 | 7 | 8 | 2 | 7 |
| | Flame retardancy | ○ | ○ | ○ | ○ | ○ | ○ |
| | Easiness of terminal treatment | ○ | ○ | ○ | ○ | x | x |
| | Cold resistance | x | ○ | ○ | ○ | ○ | ○ |

| | | Comparative example | | | |
|---|---|---|---|---|---|
| | | &5 | &6 | &9 | &10 |
| | | Blending number | | | |
| | | #9 | #7 | #1 | #10 |
| | | Conductor structure | | | |
| | | (h) | | (e) | |
| 22SQ | Easiness of mixing and processing | ○ | ○ | Δ | ○ |
| | Elongation after heating | 210 | 210 | 120 | 120 |
| | Heat resistance | ○ | Δ | Δ | ○ |
| | Distortion | 45 | 40 | 135 | 145 |
| | Flexibility | x | x | ○ | ○ |
| | Combustion time | 8 | 7 | 15 | 5 |
| | Flame retardancy | ○ | ○ | Δ | ○ |
| | Easiness of terminal treatment | ○ | ○ | x | x |
| | Cold resistance | ○ | ○ | ○ | ○ |

(1) Evaluation of Easiness of Mixing and Processing

When the wire cladding compound was mixed, the easiness of mixing and processing was evaluated from the viewpoint of adherence of the wire cladding compound to the 75 L Kneader. Compounds undergoing much loss due to excessive adherence are marked x, compounds exhibiting slight adherence but capable of being mixed are marked Δ, and compounds that are smoothly peeled and can be continued to be mixed superiorly are marked ○. Compounds marked ○ and Δ were accepted. That is, when mixing can be performed smoothly, mixing and processing can be performed with ease.

(2) Heat Resistance Test

The conductors were removed from the examples and comparative examples, and the insulators 4 were punched by using a JIS3 dumbbell to prepare test pieces. The test pieces were heat-treated at 150° C. for 3000 hours, after which they underwent a tensile test. Test pieces exhibiting elongation of 200% or more after the heating are marked ○, test pieces exhibiting elongation of 100% or more but less than 200% after the heating are marked Δ, and test pieces exhibiting elongation less than 100% after heating are marked x. Test pieces marked ○ and Δ were accepted. That is, superior in heat resistance are test pieces elongating by 100% or more when pulled after a heating process.

(3) Flexibility Test

Figure 3:
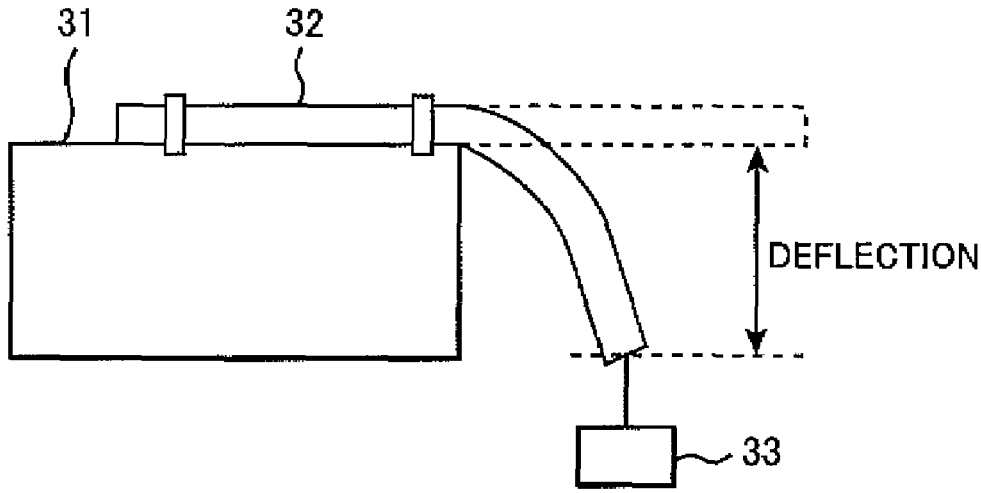
FIG. 3 is a schematic illustration for explaining the principle of a flexibility test apparatus.

A flexibility test apparatus as shown in FIG. 3 was used. FIG. 3 is a schematic illustration for explaining the principle of a flexibility test apparatus. One end of a non-halogen electric wire 32 was fixed to a pedestal 31, and the other end of the non-halogen electric wire 32 extended by 200 mm from an edge of the pedestal 31. A weight 33 was suspended from the other end. The weight Y (N) of the weight 33 was determined so that Y=X/11.7 was established between Y and the sectional area X ($mm^2$) of the conductor. That is, when the conductor size is 35SQ, the weight Y of the weight 33 is 3.0 N; when the conductor size is 22SQ, the weight Y of the weight 33 is 1.9 N. It is defined that deflection is a distance between the upper surface of the pedestal 31 and the other end of the non-halogen electric wire 32. Wires exhibiting a deflection of less than 50 mm are marked x, wires exhibiting a deflection of 50 mm or more but less than 100 mm are marked Δ, and wires exhibiting a deflection of 100 mm or more are marked ○. Wires marked ○ and Δ were accepted. That is, superior in flexibility are wires exhibiting a deflection of not less than 50 mm.

(4) Combustion Test

Flame retardancy was checked in a combustion test with an inclination of 45 degrees in accordance with ISO 6722. A combustion time after removing flame until self-digestion was measured. Insulators exhibiting a combustion time of less than 10 seconds are marked ○, insulators exhibiting a combustion time of 10 seconds or more and 70 seconds or less are marked Δ, and insulators exhibiting a combustion time of more than 70 seconds are marked x. Insulators marked ○ and Δ were accepted. That is, superior in flame retardancy are insulators exhibiting a combustion time of 70 seconds or less.

(5) Terminal Treatment Test

In order to check whether a strand is broken, an insulator with a length of 25 mm at the terminal portion of a non-halogen electric wire was removed with a terminal strip machine (NITTU Electric Industry Co., Ltd., model: ITS50X), which is of a V-blade rotary slide type. The depth by which the blade is inserted and the amount by which the blade rotates were adjusted so that there is no uncut portion in the insulator. For each of the non-halogen electric wires in the examples and comparative examples, 100 insulators were removed. The conductors from which terminal treatment was carried out in this way were visually checked, and the number of strands that were broken was counted. A non-halogen electric wire including one or more broken strands is determined to be a "strand broken" electric wire. Wires including two or more "strand broken" electric wires in 100 non-halogen electric wires are marked x, and wires including one or no "strand broken" electric wire are marked ○. Wires marked ○ were accepted. That is, easy to treat are the terminals of wires including one or no "strand broken" electric wire in 100 non-halogen electric wires.

(6) Cold Resistance Test

A non-halogen electric wire and a mandrel with a radius four times as large as the outer diameter of the non-halogen electric wire were cooled in a cooling vessel at −45° C. for 60 minutes. The non-halogen electric wire was wound three turns around the mandrel in the cooling vessel. Wires exhibiting a break or a crack on the insulator are marked x, and wires exhibiting neither a break nor a crack are marked ○. Wires marked ○ were accepted. That is, when a wire is bent with a prescribed curvature in a prescribed low-temperature environment (e.g., at −45° C.), and there is no abnormal phenomenon on the insulator, the wire is superior in cold resistance.

The results of the above tests are shown in Tables 3 to 5. The non-halogen electric wires in Examples $1 to S23 and Comparative examples &1 to &10 will be evaluated below with reference to these results.

All tests passed the non-halogen electric wires 1, in Examples $1 to $23, each of which uses any of conductors (b), (c), (f), and (g) applicable to the present invention as well as any of cladding materials with blending numbers #1 to #5, #7 to #10, and #12 to #15 applicable to the present invention. That is, these non-halogen electric wires 1 not only achieve the object of being superior in flexibility, but are easy to mix and process; are superior in heat resistance, in flame retardancy, and in cold resistance; and allow the terminal to be processed easily.

On the contrary, the non-halogen electric wires, in Comparative examples &3 to &6, each of which uses conductor (d) or (h) not applicable to the present invention due to the strand diameter greater than the stipulated value, are inferior in flexibility. The non-halogen electric wires, in Comparative examples &7 to &10, each of which uses conductor (a) or (e) not applicable to the present invention due to the strand diameter smaller than the stipulated value, are inferior in easiness of terminal treatment.

Furthermore, the non-halogen electric wires, in Comparative examples &1 and &2, each of which uses conductor (b) applicable to the present invention but uses a cladding material with blending number #6 or #11 not applicable to the present invention, are inferior in heat resistance, cold resistance, flexibility, and the like.

When Comparative examples &3 and &5 are noted, the cladding material with blending number #9 used in these wires are most flexible in the cladding materials listed in Table 2, but the flexibility of Comparative examples &3 and &5 is insufficient. Accordingly, to achieve the flexibility object, it may be important to limit the strand diameters to the range stipulated in the present invention.

When Comparative example &2 is noted, the strand diameter of the conductor (b) used in the wire is within the range stipulated in the present invention, but the flexibility of the wire is insufficient. Accordingly, to achieve the flexibility object, it may be important to use both a conductor and a cladding material applicable to the present invention.

Comparative example &1 failed in heat resistance test because the vinyl acetate was used as a vinyl monomer including an oxygen element.

Although the invention has been described with respect to the specific embodiments for complete and clear disclosure, the appended claims are not to be thus limited but are to be construed as embodying all modifications and alternative constructions that may occur to one skilled in the art which fairly fall within the basic teaching herein set forth.

What is claimed is:

1. A flexible, heat-resistant, non-halogen electric wire, comprising a conductor fabricated by twisting a plurality of strands and an insulator covering the conductor, wherein:

the diameter of each of the plurality of strands is within a range of 0.12 to 0.31 mm;

the insulator includes a resin material including an ethylene copolymer including 25 to 40 weight percent of vinyl monomer, which has an oxygen element in a molecular structure thereof, other than vinyl acetate, as a main constituent, which occupies 50 weight % or more of the resin material and also includes an elastomer as an accessory constituent, which occupies another part of the resin material;

the main constituent and the accessory constituent are mixed to prepare the resin material;

subsequently, the resin material and a metallic hydroxide are mixed to prepare a cladding material;

the conductor is covered with the cladding material; and the cladding material is then bridged to form a cross-linked resin.

2. A flexible, heat-resistant, non-halogen electric wire according to claim 1, wherein:

the metallic hydroxide is added by 50 to 300 parts by weight to 100 parts by weight of the resin material.

3. A flexible, heat-resistant, non-halogen electric wire according to claim 1, wherein:

the ethylene copolymer is prepared by chemically bonding the vinyl monomer and an ethylene, resulting in one copolymer or more than one blended copolymers selected from a group of an ethylene-ethyl acrylate copolymer (EEA), an ethylene-methyl acrylate copolymer (EMA), an ethylene-butyl acrylate copolymer (EBA), an ethylene-methyl methacrylate copolymer (EMMA), ethylene-acrylic rubber, an ethylene-ethyl acrylate-maleic anhydride terpolymer, a maleic anhydride modified EEA, a maleic anhydride modified EBA, a maleic anhydride modified EMA, an ethylene-glycidyl methacrylate copolymer, an ethylene-diethylaminoethyl methacrylate copolymer, an ethylene-dimethylaminoethyl methacrylate copolymere, an ethylene-methacrylic acid 2-hydroxyethyl copolymer, an ethylene-methacrylic acid 2-hydroxypropyl copolymer, and an ethylene-tetrahydrofurfuryl methacrylate copolymer.

4. A flexible, heat-resistant, non-halogen electric wire according to claim 1, wherein:

the elastomer is prepared by selecting one or by mixing more than one from a group of ethylene-propylene copolymer rubber (EPR), ethylene-propylene-diene terpolymer rubber (EPDM), acrylonitrile butadiene rubber (NBR), hydrogenated NBR, acrylic rubber, ethylene-acrylic ester copolymer rubber, ethylene-octene copolymer rubber (EOR), ethylene-butene-1 copolymer rubber (EBR), very low density polyethylene (VLDPE), a reactor blend (implant) thermoplastic elastomer in which olefin rubber is dispersed with a size of 1 μm or less in polypropylene (PP), styrene thermoplastic elastomers.

5. A flexible, heat resistant, non-halogen electric wire according to claim 1, wherein:

the cladding material includes a smoothness adding agent with 5 weight percent or less of the added metallic hydroxide to 100 weight parts of the resin material.

6. A flexible, heat-resistant, non-halogen electric wire according to claim 5, wherein:

the smoothness adding agent has a melting point of 100□C or below, and is any one of fatty acid metallic salt, fatty acid amide, fatty acid ester, fatty acid ester of polyalcohol, and a derivative of fatty acid ester of polyalcohol.

7. A flexible, heat-resistant, non-halogen electric wire according to claim 1, wherein:

the vinyl monomer is ethyl acrylate or methyl acrylate.

8. A flexible, heat-resistant non-halogen electric wire according to claim 1, wherein:

a surface of the conductor is plated with tin, nickel, silver, or gold.

9. A flexible, heat-resistant, non-halogen electric wire according to claim 1, wherein:

an outer periphery of the conductor is wound by a plastic, paper, cloth, or metal foil separator tape.

10. A flexible, heat-resistant, non-halogen electric wire according to claim 1, wherein:

an electromagnetic shield comprising braided metal wires, a metal tape, or conductive resin is provided on the outer periphery of the conductor.

11. A flexible, heat-resistant, non-halogen electric wire according to claim 1, wherein the main constituent occupies more than 50 weight % of the resin material.

* * * * *